US005382373A

United States Patent [19]

Carlson et al.

[11] Patent Number: 5,382,373

[45] Date of Patent: Jan. 17, 1995

[54] MAGNETORHEOLOGICAL MATERIALS BASED ON ALLOY PARTICLES

[75] Inventors: J. David Carlson; Keith D. Weiss, both of Erie, Pa.

[73] Assignee: Lord Corporation, Erie, Pa.

[21] Appl. No.: 968,734

[22] Filed: Oct. 30, 1992

[51] Int. Cl.[6] ..... H01F 1/28

[52] U.S. Cl. ..... 252/62.55; 252/62.52; 252/62.54

[58] Field of Search ..... 252/62.55, 62.52, 62.54, 252/513

[56] References Cited

U.S. PATENT DOCUMENTS

| | | | |
|---|---|---|---|
| Re. 32,573 | 1/1988 | Furumura et al. | 252/62.52 |
| 2,575,360 | 11/1951 | Rabinow | 192/21.5 |
| 2,661,596 | 12/1953 | Winslow . | |
| 2,661,825 | 12/1953 | Winslow | 192/21.5 |
| 2,663,809 | 12/1953 | Winslow | 310/78 |
| 2,667,237 | 1/1954 | Rabinow . | |
| 2,670,749 | 3/1954 | Germer | 137/1 |
| 2,733,792 | 2/1956 | Saxl | 192/21.5 |
| 2,751,352 | 6/1956 | Bondi | 252/62.52 |
| 2,847,101 | 8/1958 | Bergmann | 252/62.52 |
| 2,886,151 | 5/1959 | Winslow | 192/21.5 |
| 3,010,471 | 11/1961 | Gross . | |
| 3,700,595 | 10/1972 | Kaiser | 252/62.52 |
| 3,917,538 | 11/1975 | Rosenweig | 252/62.52 |
| 4,992,190 | 2/1991 | Shtarkman | 252/62.52 |
| 5,013,471 | 5/1991 | Ogawa | 252/62.52 |
| 5,147,573 | 9/1992 | Chagnon | 252/62.51 |

OTHER PUBLICATIONS

Kirk-Othmer Encyclopedia of Chemical Technology, vol. 14, pp. 662-664, (1981).

J. Rabinow, "Technical News Bulletin," vol. 32, No. 5, pp. 54-60, issued by U.S. Dept. of Commerce, May, 1948 describing a magnetic fluid clutch.

*Primary Examiner*—Prince Willis, Jr.
*Assistant Examiner*—Alan D. Diamond
*Attorney, Agent, or Firm*—W. Graham Buie

[57] ABSTRACT

A magnetorheological material containing a carrier fluid and an iron alloy particle component. The particle component can be either an iron-cobalt alloy or an iron-nickel alloy. The iron-cobalt alloy has an iron:-cobalt ratio ranging from about 30:70 to 95:5 while the iron-nickel alloy has an iron:nickel ratio ranging from about 90:10 to 99:1. The iron alloy particle components are capable of imparting high yield stress capability to magnetorheological materials.

16 Claims, 1 Drawing Sheet

MAGNETORHEOLOGICAL MATERIALS BASED ON ALLOY PARTICLES

FIELD OF THE INVENTION

The present invention relates to fluid materials which exhibit substantial increases in flow resistance when exposed to magnetic fields. More specifically, the present invention relates to magnetorheological materials that exhibit an enhanced yield stress due to the use of certain iron alloy particles.

BACKGROUND OF THE INVENTION

Fluid compositions which undergo a change in apparent viscosity in the presence of a magnetic field are commonly referred to as Bingham magnetic fluids or magnetorheological materials. Magnetorheological materials normally are comprised of ferromagnetic or paramagnetic particles, typically greater than 0.1 micrometers in diameter, dispersed within a carrier fluid and in the presence of a magnetic field, the particles become polarized and are thereby organized into chains of particles within the fluid. The chains of particles act to increase the apparent viscosity or flow resistance of the overall material and in the absence of a magnetic field, the particles return to an unorganized or free state and the apparent viscosity or flow resistance of the overall material is correspondingly reduced. These Bingham magnetic fluid compositions exhibit controllable behavior similar to that commonly observed for electrorheological materials, which are responsive to an electric field instead of a magnetic field.

Both electrorheological and magnetorheological materials are useful in providing varying damping forces within devices, such as dampers, shock absorbers and elastomeric mounts, as well as in controlling torque and or pressure levels in various clutch, brake and valve devices. Magnetorheological materials inherently offer several advantages over electrorheological materials in these applications. Magnetorheological fluids exhibit higher yield strengths than electrorheological materials and are, therefore, capable of generating greater damping forces. Furthermore, magnetorheological materials are activated by magnetic fields which are easily produced by simple, low voltage electromagnetic coils as compared to the expensive high voltage power supplies required to effectively operate electrorheological materials. A more specific description of the type of devices in which magnetorheological materials can be effectively utilized is provided in copending U.S. patent application Ser. Nos. 07/900,571 and 07/900,567 entitled "Magnetorheological Fluid Dampers" and "Magnetorheological Fluid Devices," respectively, both filed on Jun. 18, 1992, the entire contents of which are incorporated herein by reference.

Magnetorheological or Bingham magnetic fluids are distinguishable from colloidal magnetic fluids or ferrofluids. In colloidal magnetic fluids the particles are typically 5 to 10 nanometers in diameter. Upon the application of a magnetic field, a colloidal ferrofluid does not exhibit particle structuring or the development of a resistance to flow. Instead, colloidal magnetic fluids experience a body force on the entire material that is proportional to the magnetic field gradient. This force causes the entire colloidal ferrofluid to be attracted to regions of high magnetic field strength.

Magnetorheological fluids and corresponding devices have been discussed in various patents and publications. For example, U.S. Pat. No. 2,575,360 provides a description of an electromechanically controllable torque-applying device that uses a magnetorheological material to provide a drive connection between two independently rotating components, such as those found in clutches and brakes. A fluid composition satisfactory for this application is stated to consist of 50% by volume of a soft iron dust, commonly referred to as "carbonyl iron powder", dispersed in a suitable liquid medium such as a light lubricating oil.

Another apparatus capable of controlling the slippage between moving parts through the use of magnetic or electric fields is disclosed in U.S. Pat. No. 2,661,825. The space between the moveable parts is filled with a field responsive medium. The development of a magnetic or electric field flux through this medium results in control of resulting slippage. A fluid responsive to the application of a magnetic field is described to contain carbonyl iron powder and light weight mineral oil.

U.S. Pat. No. 2,886,151 describes force transmitting devices, such as clutches and brakes, that utilize a fluid film coupling responsive to either electric or magnetic fields. An example of a magnetic field responsive fluid is disclosed to contain reduced iron oxide powder and a lubricant grade oil having a viscosity of from 2 to 20 centipoises at 25° C.

The construction of valves useful for controlling the flow of magnetorheological fluids is described in U.S. Pat. Nos. 2,670,749 and 3,010,471. The magnetic fluids applicable for utilization in the disclosed valve designs include ferromagnetic, paramagnetic and diamagnetic materials. A specific magnetic fluid composition specified in U.S. Pat. No. 3,010,471 consists of a suspension of carbonyl iron in a light weight hydrocarbon oil. Magnetic fluid mixtures useful in U.S. Pat. No. 2,670,749 are described to consist of a carbonyl iron powder dispersed in either a silicone oil or a chlorinated or fluorinated suspension fluid.

Various magnetorheological material mixtures are disclosed in U.S. Pat. No. 2,667,237. The mixture is defined as a dispersion of small paramagnetic or ferromagnetic particles in either a liquid, coolant, antioxidant gas or a semi-solid grease. A preferred composition for a magnetorheological material consists of iron powder and light machine oil. A specifically preferred magnetic powder is stated to be carbonyl iron powder with an average particle size of 8 micrometers. Other possible carrier components include kerosene, grease, and silicone oil.

U.S. Pat. No. 4,992,190 discloses a rheological material that is responsive to a magnetic field. The composition of this material is disclosed to be magnetizable particles and silica gel dispersed in a liquid carrier vehicle. The magnetizable particles can be powdered magnetite or carbonyl iron powders with insulated reduced carbonyl iron powder, such as that manufactured by GAF Corporation, being specifically preferred. The liquid carrier vehicle is described as having a viscosity in the range of 1 to 1000 centipoises at 100° F. Specific examples of suitable vehicles include Conoco LVT oil, kerosene, light paraffin oil, mineral oil, and silicone oil. A preferred carrier vehicle is silicone oil having a viscosity in the range of about 10 to 1000 centipoise at 100° F.

In many demanding applications for magnetorheological materials, such as dampers or brakes for automobiles or trucks, it is desirable for the magnetorheological material to exhibit a high yield stress so as to be capable of tolerating the large forces experienced in these types of applications. It has been found that only a nominal increase in yield stress of a given magnetorheological material can be obtained by selecting among the different iron particles traditionally utilized in magnetorheological materials. In order to increase the yield stress of a given magnetorheological material, it is typically necessary to increase the volume fraction of magnetorheological particles or to increase the strength of the applied magnetic field. Neither of these techniques is desirable since a high volume fraction of the particle component can add significant weight to a magnetorheological device, as well as increase the overall off-state viscosity of the material, thereby restricting the size and geometry of a magnetorheological device capable of utilizing that material, and high magnetic fields significantly increase the power requirements of a magnetorheological device.

A need therefore exists for a magnetorheological particle component that will independently increase the yield stress of a magnetorheological material without the need for an increased particle volume fraction or increased magnetic field.

SUMMARY OF THE INVENTION

The present invention is a magnetorheological material that utilizes a particle component which is capable of independently increasing the yield stress of the overall magnetorheological material. Specifically, the invention is a magnetorheological material comprising a carrier fluid and a particle component wherein the particle component is comprised of an iron alloy selected from the group consisting of iron-cobalt alloys having an iron:cobalt ratio ranging from about 30:70 to 95:5 and iron-nickel alloys having an iron:nickel ratio ranging from about 90:10 to 99:1. It has presently been discovered that iron-cobalt and iron-nickel alloys having the specific ratios disclosed herein are unusually effective when utilized as the particle component of a magnetorheological material. A magnetorheological material prepared with the present iron alloys exhibits a significantly improved yield stress as compared to a magnetorheological material prepared with traditional iron particles.

DETAILED DESCRIPTION OF THE INVENTION

Figure 1:
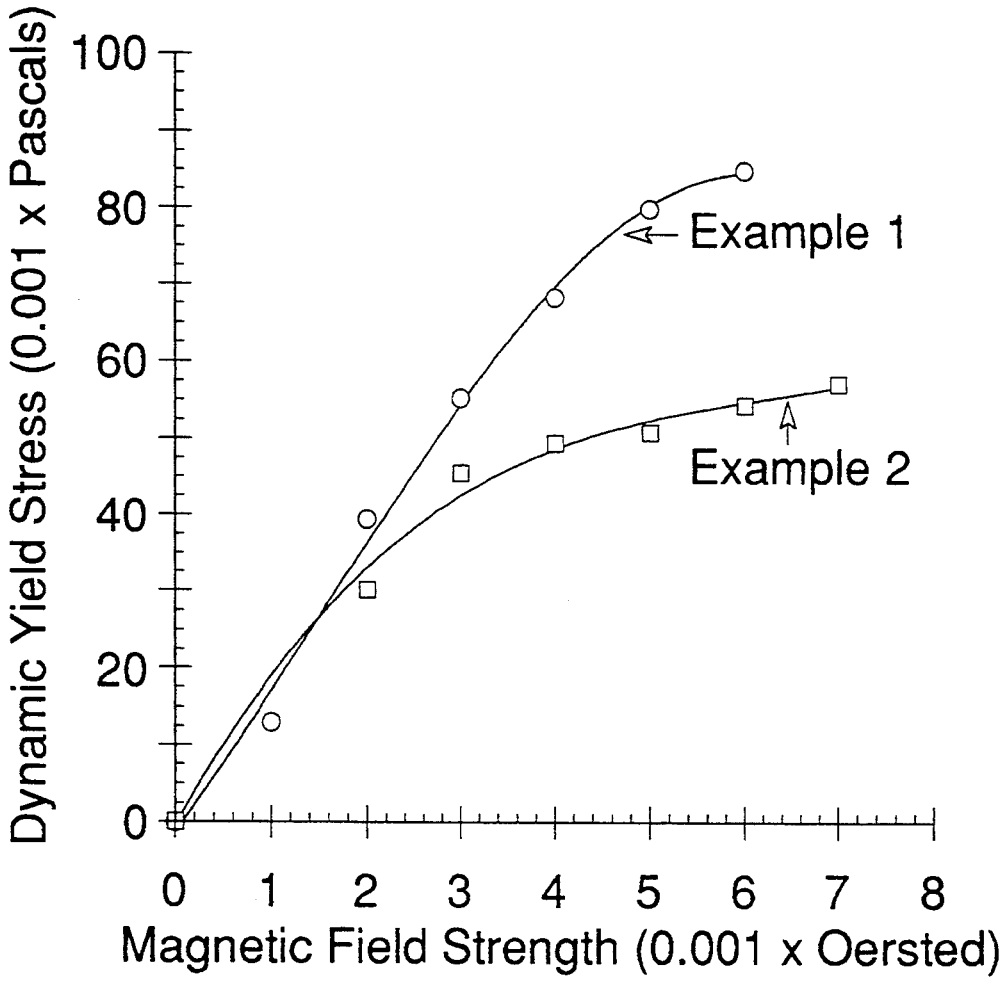
FIG. 1 is a plot of dynamic yield stress at 25° C. as a function of magnetic field strength for magnetorheological materials prepared in accordance with Example 1 and Comparative Example 2.

The present invention relates to a magnetorheological material comprising a carrier fluid and an iron-cobalt or iron-nickel alloy particle component. The iron-cobalt alloys of the invention have an iron:cobalt ratio ranging from about 30:70 to 95:5, preferably ranging from about 50:50 to 85:15, while the iron-nickel alloys have an iron:nickel ratio ranging from about 90:10 to 99:1, preferably ranging from about 94:6 to 97:3. The iron alloys may contain a small amount of other elements, such as vanadium, chromium, etc, in order to improve the ductility and mechanical properties of the alloys. These other elements are typically present in an amount that is less than about 3.0% by weight. The diameter of the particles utilized herein can range from about 0.1 to 500 μm, preferably from about 0.5 to 100 μm, with about 1.0 to 50 μm being especially preferred. Due to their ability to generate somewhat higher yield stresses, the iron-cobalt alloys are presently preferred over the iron-nickel alloys for utilization as the particle component in a magnetorheological material. Examples of the preferred iron-cobalt alloys can be commercially obtained under the tradenames HYPERCO (Carpenter Technology), HYPERM (F. Krupp Widiafabrik), SUPERMENDUR (Arnold Eng.) and 2V-PERMENDUR (Western Electric).

The iron alloys of the invention are typically in the form of a metal powder which can be prepared by processes well known to those skilled in the art. Typical methods for the preparation of metal powders include the reduction of metal oxides, grinding or attrition, electrolytic deposition, metal carbonyl decomposition, rapid solidification, or smelt processing. Many of the iron alloy particle components of the present invention are commercially available in the form of powders. For example, [48%]Fe/[50%]Co/[2%]V powder can be obtained from UltraFine Powder Technologies.

The iron alloy particle component typically comprises from about 5 to 50, preferably about 10 to 45, with about 20 to 35 percent by volume of the total magnetorheological material being especially preferred depending on the desired magnetic activity and viscosity of the overall material. This corresponds to about 31.0 to 89.5, preferably about 48.6 to 87.5, with about 68.1 to 82.1 percent by weight being especially preferred when the carrier fluid and the particle component of the magnetorheological material have a specific gravity of about 0.95 and 8.10, respectively.

The carrier fluid of the magnetorheological material of the present invention can be any carrier fluid or vehicle previously disclosed for use in magnetorheological materials such as the mineral oils, silicone oils, and paraffin oils described in the patents set forth above. Additional carrier fluids appropriate to the present invention include silicone copolymers, white oils, hydraulic oils, chlorinated hydrocarbons, transformer oils, halogenated aromatic liquids, halogenated paraffins, diesters, polyoxyalkylenes, perfluorinated polyethers, fluorinated hydrocarbons, fluorinated silicones, and mixtures thereof. As known to those familiar with such compounds, transformer oils refer to those liquids having characteristic properties of both electrical and thermal insulation. Naturally occurring transformer oils include refined mineral oils that have low viscosity and high chemical stability. Synthetic transformer oils generally comprise chlorinated aromatics (chlorinated biphenyls and trichlorobenzene), which are known collectively as "askarels", silicone oils, and esteric liquids such as dibutyl sebacates.

Additional carrier fluids suitable for use in the present invention include the silicone copolymers, hindered ester compounds and cyanoalkylsiloxane homopolymers disclosed in co-pending U.S. Pat. application Ser. No. 07/942,549 filed Sep. 9, 1992, and entitled "High Strength, Low Conductivity Electrorheological Materials," the entire disclosure of which is incorporated herein by reference. The carrier fluid of the invention may also be a modified carrier fluid which has been modified by extensive purification or by the formation of a miscible solution with a low conductivity carrier fluid so as to cause the modified carrier fluid to have a conductivity less than about $1\times10^{-7}$ S/m. A detailed description of these modified carrier fluids can be found in the U.S. patent application entitled "Modified Electrorheological Materials Having Minimum Conductivity," filed Oct. 16, 1992, by Applicants B. C. Mufioz, S. R. Wasserman, J. D. Carlson, and K. D. Weiss, and also assigned to the present assignee, the entire disclosure of which is incorporated herein by reference.

Polysiloxanes and perfiuorinated polyethers having a viscosity between about 3 and 200 centipoise at 25° C. are also appropriate for utilization in the magnetorheological material of the present invention. A detailed description of these low viscosity polysiloxanes and perfiuorinated polyethers is given in the U.S. patent application entitled "Low Viscosity Magnetorheological Materials," filed concurrently herewith by Applicants K. D. Weiss, J. D. Carlson, and T. G. Duclos, and also assigned to the present assignee, the entire disclosure of which is incorporated herein by reference. The preferred carrier fluids of the present invention include mineral oils, paraffin oils, silicone oils, silicone copolymers and perfiuorinated polyethers, with silicone oils and mineral oils being especially preferred.

The carrier fluid of the magnetorheological material of the present invention should have a viscosity at 25° C. that is between about 2 and 1000 centipoise, preferrably between about 3 and 200 centipoise, with a viscosity between about 5 and 100 centipoise being especially preferred. The carrier fluid of the present invention is typically utilized in an amount ranging from about 50 to 95, preferably from about 55 to 90, with from about 65 to 80 percent by volume of the total magnetorheological material being especially preferred. This corresponds to about 10.5 to 69.0, preferably about 12.5 to 51.4, with about 17.9 to 31.9 percent by weight being especially preferred when the carrier fluid and particle component of the magnetorheological material have a specific gravity of about 0.95 and 8.10, respectively.

A surfactant to disperse the particle component may also be optionally utilized in the present invention. Such surfactants include known surfactants or dispersing agents such as ferrous oleate and naphthenate, metallic soaps (e.g., aluminum tristearate and distearate), alkaline soaps (e.g., lithium and sodium stearate), sulfonates, phosphate esters, stearic acid, glycerol monooleate, sorbitan sesquioleate, stearates, laurates, fatty acids, fatty alcohols, and the other surface active agents discussed in U.S. Pat. No. 3,047,507 (incorporated herein by reference). In addition, the optional surfactant may be comprised of steric stabilizing molecules, including fluoroaliphatic polymeric esters, such as FC-430 (3M Corporation), and titanate, aluminate or zirconate coupling agents, such as KEN-REACT (Kenrich Petrochemicals, Inc.) coupling agents. The optional surfactant may also be hydrophobic metal oxide powders, such as AEROSIL R972, R974, EPR 976, R805 and R812 (Degussa Corporation) and CABOSIL TS-530 and TS-610 (Cabot Corporation) surface-treated hydrophobic fumed silica. Finally, a precipitated silica gel, such as that disclosed in U.S. Pat. No. 4,992,190 (incorporated herein by reference), can be used to disperse the particle component. In order to reduce the presence of moisture in the magnetorheological material, it is preferred that the precipitated silica gel, if utilized, be dried in a convection oven at a temperature of from about 110° C. to 150° C. for a period of time from about 3 to 24 hours.

The surfactant, if utilized, is preferably a hydrophobic fumed silica, a "dried" precipitated silica gel, a phosphate ester, a fluoroaliphatic polymeric ester, or a coupling agent. The optional surfactant may be employed in an amount ranging from about 0.1 to 20 percent by weight relative to the weight of the particle component.

Particle settling may be minimized in the magnetorheological materials of the invention by forming a thixotropic network. A thixotropic network is defined as a suspension of particles that at low shear rates form a loose network or structure, sometimes referred to as clusters or flocculates. The presence of this three-dimensional structure imparts a small degree of rigidity to the magnetorheological material, thereby, reducing particle settling. However, when a shearing force is applied through mild agitation this structure is easily disrupted or dispersed. When the shearing force is removed this loose network is reformed over a period of time.

A thixotropic network or structure is formed through the utilization of a hydrogen-bonding thixotropic agent and/or a polymer-modified metal oxide. Colloidal additives may also be utilized to assist in the formation of the thixotropic network. The formation of a thixotropic network utilizing hydrogen-bonding thixotropic agents, polymer-modified metal oxides and colloidal additives is further described in the U.S. Patent application entitled "Thixotropic Magnetorheological Materials," filed concurrently herewith by applicants K. D. Weiss, D. A. Nixon, J. D. Carlson and A. J. Margida and also assigned to the present assignee, the entire disclosure of which is incorporated herein by reference.

The formation of a thixotropic network in the invention can be assisted by the addition of low molecular weight hydrogen-bonding molecules, such as water and other molecules containing hydroxyl, carboxyl or amine functionality. Typical low molecular weight hydrogen-bonding molecules other than water include methyl, ethyl, propyl, isopropyl, butyl and hexyl alcohols; ethylene glycol; diethylene glycol; propylene glycol; glycerol; aliphatic, aromatic and heterocyclic amines, including primary, secondary and tertiary amino alcohols and amino esters that have from 1–16 atoms of carbon in the molecule; methyl, butyl, octyl, dodecyl, hexadecyl, diethyl, diisopropyl and dibutyl amines; ethanolamine; propanolamine; ethoxyethylamine; dioctylamine; triethylamine; trimethylamine; tributylamine; ethylene-diamine; propylene-diamine; triethanolamine; triethylenetetramine; pyridine; morpholine; imidazole; and mixtures thereof. The low molecular weight hydrogen-bonding molecules, if utilized, are typically employed in an amount ranging from about 0.1 to 10.0, preferably from about 0.5 to 5.0, percent by weight relative to the weight of the particle component.

The magnetorheological materials of the present invention can be prepared by initially mixing the ingredients together by hand (low shear) with a spatula or the like and then subsequently more thoroughly mixing (high shear) with a homogenizer, mechanical mixer or shaker or dispersing with an appropriate milling device such as a ball mill, sand mill, attritor mill, colloid mill, paint mill, or the like, in order to create a more stable suspension.

Evaluation of the mechanical properties and characteristics of the magnetorheological materials of the present invention, as well as other magnetorheological materials, can be obtained through the use of parallel plate and/or concentric cylinder couette rheometry. The theories which provide the basis for these techniques are adequately described by S. Oka in *Rheology, Theory*

*and Applications* (volume 3, F. R. Eirich, ed., Academic Press: New York, 1960) the entire contents of which are incorporated herein by reference. The information that can be obtained from a rheometer includes data relating mechanical shear stress as a function of shear strain rate. For magnetorheological materials, the shear stress versus shear strain rate data can be modeled after a Bingham plastic in order to determine the dynamic yield stress and viscosity. Within the confines of this model the dynamic yield stress for the magnetorheological material corresponds to the zero-rate intercept of a linear regression curve fit to the measured data. The magnetorheological effect at a particular magnetic field can be further defined as the difference between the dynamic yield stress measured at that magnetic field and the dynamic yield stress measured when no magnetic field is present. The viscosity for the magnetorheological material corresponds to the slope of a linear regression curve fit to the measured data.

In a concentric cylinder cell configuration the magnetorheological material is placed in the annular gap formed between an inner cylinder of radius $R_1$ and an outer cylinder of radius $R_2$, while in a simple parallel plate configuration the material is placed in the planar gap formed between upper and lower plates both with a radius, $R_3$. In these techniques either one of the plates or cylinders is then rotated with an angular velocity $\omega$ while the other plate or cylinder is held motionless. A magnetic field can be applied to these cell configurations across the fluid-filled gap, either radially for the concentric cylinder configuration, or axially for the parallel plate configuration. The relationship between the shear stress and the shear strain rate is then derived from this angular velocity and the torque, T, applied to maintain or resist it.

The following examples are given to illustrate the invention and should not be construed to limit the scope of the invention.

EXAMPLE 1

A magnetorheological material is prepared by initially mixing together 112.00 grams of an iron-cobalt alloy powder consisting of [48%]Fe/[50%]Co/[2%]V obtained from UltraFine Powder Technologies, 2.24 grams of stearic acid (Aldrich Chemical Company) as a dispersant and 30.00 grams of 200 centistoke silicone oil (L-45, Union Carbide Chemicals & Plastics Company, Inc.). The weight amount of iron-cobalt alloy particles in this magnetorheological material corresponds to a volume fraction of 0.30. The magnetorheological material is made homogeneous by dispersing on an attritor mill for a period of 24 hours. The magnetorheological material is stored in a polyethylene container until utilized.

COMPARATIVE EXAMPLE 2

A magnetotheological material is prepared according to the procedure described in Example 1. In this case the particle component consists of 117.90 grams of an insulated reduced carbonyl iron powder (MICROPOWDER R-2521, GAF Chemical Corporation, similar to old GQ4 and GS6 powder notation). An appropriate amount of stearic acid and silicone oil is utilized in order to maintain the volume fraction of the particle component at 0.30. This magnetorheological material is stored in a polyethylene container until utilized.

Magnetorheological Activity

The magnetorheological materials prepared in Examples 1and 2 are evaluated through the use of parallel plate rheometry. A summary of the dynamic yield stress values obtained for these magnetorheolgical materials at 25° C. is provided in FIG. 1 as a function of magnetic field. Higher yield stress values are obtained for the magnetorheological material utilizing the iron-cobalt alloy particles (Example 1) as compared to the insulated reduced carbonyl iron powder (Example 2). At a magnetic field strength of 6000 Oersted the yield stress exhibited by the magnetorheological material containing the iron-cobalt alloy particles is about 70% greater than that exhibited by the reduced iron-based magnetorheological material.

As can be seen from the data in FIG. 1, the iron alloy particles of the present invention provide for magnetorheological materials which exhibit substantially higher yield stresses than magnetorheological materials based on traditional iron particles.

What is claimed is:

1. A magnetorheological material comprising a carrier fluid; a particle component having a diameter ranging from about 1.0 to 500 μm wherein the particle component is comprised of an iron alloy selected from the group consisting of iron-cobalt alloys having an iron:cobalt weight ratio ranging from about 50:50 to 85:15 and iron-nickel alloys having an iron:nickel weight ratio ranging from about 90:10 to 99:1, the iron alloy particle component being present in an amount from about 20 to 35 percent by volume and the carrier fluid being present in an amount from about 65 to 80 percent by volume; a surfactant; and a thixotropic agent.

2. A magnetorheological material according to claim 1 wherein the iron alloys contain less than about 3 percent by weight of vanadium or chromium.

3. A magnetorheological material according to claim 1 wherein the diameter ranges from about 0.5 to 100 μm.

4. A magnetorheological material according to claim 3 wherein the diameter ranges from about 1 to 50 μm.

5. A magnetorheological material according to claim 1 wherein the carrier fluid is selected from the group consisting of mineral oils, silicone oils, halogenated aromatic liquids, halogenated paraffins, diesters, polyoxyalkylenes, perfluorinated polyethers, fluorinated silicones, and mixtures thereof.

6. A magnetorheological material according to claim 5 wherein the carrier fluid has a viscosity at 25° C. between about 2 and 1000 centipoise.

7. A magnetorheological material according to claim 6 wherein the viscosity at 25° C. is between about 3 and 200 centipoise.

8. A magnetorheological material according to claim 7 wherein the viscosity at 25° C. is between about 5 and 100 centipoise.

9. A magnetorheological material according to claim 5 wherein the carrier fluid is selected from the group consisting of mineral oils, silicone oils, and perfluorinated polyethers.

10. A magnetorheological material according to claim 9 wherein the carrier fluid is a silicone oil or a mineral oil.

11. A magnetorheological material according to claim 1 wherein the surfactant is selected from the group consisting of ferrous oleate and naphthenate, aluminum soaps, alkaline soaps, sulfonates, phosphate esters, glycerol monooleate, sorbitan sesquioleate, fatty acids, fatty alcohols, fluoroaliphatic polymeric esters, hydrophobic fumed silica, precipitated silica gel, and titanate, aluminate and zirconate coupling agents.

12. A magnetorheological material according to claim 11 wherein the surfactant is hydrophobic fumed silica, precipitated silica gel, a phosphate ester, a fluoroaliphatic polymeric ester or a titanate, aluminate or zirconate coupling agent.

13. A magnetorheological material according to claim 12 wherein the precipitated silica gel is a dried precipitated silica gel obtained by drying the silica gel in a convection oven at a temperature of from about 110° C. to 150° C. for a period of time from about 3 hours to about 24 hours.

14. A magnetorheological material according to claim 1 wherein the surfactant is present in an amount ranging from about 0.1 to 20 percent by weight relative to the weight of the particle component.

15. A magnetotheological material according to claim 1 wherein the thixotropic agent comprises a low molecular weight hydrogen-bonding molecule containing a hydroxyl, carboxyl, or amine functionality.

16. A magnetorheological material according to claim 15 wherein the low molecular weight hydrogen-bonding molecule is selected from the group consisting of water; methyl, ethyl, propyl, isopropyl, butyl and hexyl alcohols; ethylene glycol; diethylene glycol; propylene glycol; glycerol; aliphatic, aromatic and heterocyclic amines; primary, secondary and tertiary amino alcohols and amino esters that have from 1–16 atoms of carbon in the molecule; and mixtures thereof.

* * * * *